US006739277B2

(12) United States Patent
Knight

(10) Patent No.: US 6,739,277 B2
(45) Date of Patent: May 25, 2004

(54) ADJUSTABLE CENTERLINE FOOT BRACE SYSTEM

(75) Inventor: Robert A. Knight, Somerset, CA (US)

(73) Assignee: Watermark Paddlesports, Inc., Easley, SC (US)

( * ) Notice: Subject to any disclaimer, the term of this patent is extended or adjusted under 35 U.S.C. 154(b) by 0 days.

(21) Appl. No.: 09/895,592

(22) Filed: Jun. 29, 2001

(65) Prior Publication Data

US 2002/0005157 A1 Jan. 17, 2002

Related U.S. Application Data

(60) Provisional application No. 60/218,292, filed on Jul. 12, 2000.

(51) Int. Cl.[7] ..... B63B 35/71
(52) U.S. Cl. ..... 114/347; 114/363
(58) Field of Search ..... 114/363, 347

(56) References Cited

U.S. PATENT DOCUMENTS

| | | | |
|---|---|---|---|
| 3,982,293 A | | 9/1976 | Lagervall |
| 4,229,850 A | * | 10/1980 | Arcouette |
| 4,244,602 A | | 1/1981 | Allsop et al. |
| 4,589,365 A | | 5/1986 | Masters |
| 4,744,327 A | | 5/1988 | Masters |
| 4,942,840 A | | 7/1990 | Masters |
| 5,367,976 A | | 11/1994 | Van Shaik |
| 5,544,613 A | | 8/1996 | Scarborough et al. |
| 5,975,006 A | | 11/1999 | Lewitt |

* cited by examiner

*Primary Examiner*—Sherman Basinger
(74) *Attorney, Agent, or Firm*—McNair Law Firm, PA; Cort Flint

(57) ABSTRACT

An adjustable foot brace and optional shock absorbing system for decked kayaks that employs a heel and arch of the foot contact, and in which the adjustment arms are selectively securely affixed to a base plate located in the center of the kayak from the forward most portion of the seat or central structural support member forward. This base plate is then securely affixed to the forward most portion of the seat of the kayak, or to the forward most portion of a central structural support member in boats utilizing this device. The bulkhead configuration for this foot brace system employs a full or near full foot contact and the adjustment arm is attached directly to a guide located in the forward most portion of the seat or central structural support member for boats using this device. Either of these foot brace systems may also be attached in a "floating" configuration to an optional shock absorbing mechanism. The excess or unused portion of the adjustment arms or arm is guided inside the forward most portion of the seat, or central structural support member.

10 Claims, 15 Drawing Sheets

ADJUSTABLE CENTERLINE FOOT BRACE SYSTEM

CROSS REFERENCES

Provisional Patent Application No. 60/218,292 filed on Jul. 12, 2000

BACKGROUND OF THE INVENTION

In the sport of kayaking, and especially in the subcategory of that sport practiced in rivers and commonly referred to as "whitewater" kayaking, it is important that the user of the kayak have a snug, comfortable fit, within the boat. A foot brace system is one of the bracing systems commonly used by most paddlers for that purpose. The foot brace systems currently employed in most kayaks could be arranged into 3 categories:

1. Track. The first iteration of this system was invented by Otto Lagervall in 1976, (U.S. Pat. No. 3,982,293) and is comprised of 2 foot braces, each consisting of a track, and a pedal, which can be adjusted incrementally, forwardly and rearwardly along the length of these tracks. These braces are bolted to the sides of the kayak and the balls of the boater's feet rest against these pedals. This type of bracing system occupies a minimum of 1½ to 2 inches of space (laterally) when installed in the boat.
2. Bulkhead. This system employs a single foot brace (pedal portion) that spans the width of the hull. Adjustment arms or straps are attached to the outer side portions of this bulkhead and run back along the inside of the boat to a point where they are bolted to the sides of the boat. The balls of the feet, or in the case of smaller users, the whole of each foot rests against this bulkhead. Almost every kayak manufacturer fabricate their own bulkhead style foot brace, and because of the location of the adjusting arms and the shape of a kayak, they can also occupy up to 2 or more inches of space that could otherwise be used for foot room.
3. Stationary. This system can be found to use either a bulkhead or a pedal design that is manufactured in a variety of materials from foam to metal, and the brace (s) is/are positioned in a location that allows a users feet to rest against it/them This type of foot bracing system is permanently fixed by various methods in a location specific to a single user. Once again, the balls of the feet, or perhaps the whole of each foot is resting against it/them.

The first 2 of these systems have been the primary methods kayak manufacturers have employed for the last 25 years. The evolution of the sport of kayaking, however, has taken the 13' 2" boat of the past and whittled it down to 8' and less. These modem "play" or "Rodeo-type" boats are being designed to employ cartwheel type maneuvers that involve sequentially burying the ends of the boat into the water. Kayak manufacturers have further paired foot room from the ends of the boat in order to facilitate that maneuver, and the result is a boat that has seriously reduced room for feet much less adjustable foot brace mechanisms. For that reason, stationary style foot brace systems are currently being employed by most manufacturers, the most common of which uses foam to fill in the gap from the forward most portion of the inside of the kayak back to where the users feet are located. This system has serious limitations. It is not adjustable, allowing a user to modify the position of their feet within the kayak at will. It does not provide a method for users having different foot size or leg length to trade or try out different kayaks without extensive modification of the foot brace system. Foam compresses with use, and thereby renders the foot brace inadequate for applying necessary force against it. Foam braces can also deform the bow end of plastic boats in the process of being repeatedly compressed within that space.

There are other negative properties associated with current designs of track and bulkhead style foot braces. A person in a normal sitting position within a decked kayak will have their legs extended in front of them, knees up and bent and the heels of the feet resting against the hull of the boat. The heels are usually close together in the center of the boat with the feet pointed outwardly and forwardly. Track style foot braces are designed for a ball of the foot contact, and are located on opposing sides of the kayak and far enough forward to be useful in bracing the feet of the user. This position directs the feet of the user outwardly toward the smaller portions of the boat. Bulkhead style foot braces are also designed for a ball of the foot, or full foot contact, and although there is greater freedom to move the feet in a plurality of positions, the feet are still generally directed outwardly toward the smaller portions of the hull.

There is a clear and present need for a foot brace system for decked kayaks which is secure, comfortable, and adjustable, and which maximizes the available foot room within the boat. A simple, lightweight, and cost effective shock absorbing system would also greatly benefit the paddler.

SUMMARY OF THE INVENTION

The Adjustable Centerline Foot Brace System of the present invention is designed to overcome the above-noted shortcomings and to fulfill the stated needs. It is comprised of foot brace and optional shock absorber systems that can be used in kayaks of all types, and would be most beneficial in the small "rodeo-style" kayaks, and in the larger "steep-creek" kayaks that are commonly used for running difficult whitewater.

A completely new concept of how to brace the foot within a kayak is necessary to address these problems. A foot brace that utilizes the heel and arch of the foot as the primary contact point takes advantage of the anatomy of the leg and foot to solve many of these issues:

1. Less lateral room is required within the "rodeo-style" kayaks because the heel and arch of the foot is the contact point and the rest of the foot can be directed more forwardly around the end of the brace.
2. This position is comfortable for the foot, and orients the feet of the user in a direction that more fully optimizes the available space.
3. A heel/arch contact point reduces the hinge effect created by the ankle and creates a better bracing position by eliminating the possibility of forward travel of the heel. This ensures that the knee will remain firmly engaged within the knee brace structure.
4. The shock absorbing mechanism described herein may be used in conjunction with this pedal-style bracing system, or with the bulkhead iteration of this system to reduce the possibility of injury do to severe impacts against the bow of the boat.

The inventive assembly described herein includes means for foot-receiving pedal style members designed to contact the heel and arch of each foot. Means are provided for securely affixing said foot-receiving members to adjustments arms. Further means are provided to do so in such a way as to utilize all but ¾'s of an inch of available lateral space for foot room. Also included are means for selectively securing these adjustment arms in a plurality of incrementally different positions forwardly or rearwardly through pivoting brackets which are attached to a base plate located along the centerline of the hull. Means are also provided for slidingly moving the adjustment arm/s of the bracing system through said pivoting brackets that will then allow the adjustment arms to assume different angles along the changing contour of the hull. Further means are provided for guiding the adjustment arms to and, when necessary, within the forward most portion of the seat or central structural support member in boats utilizing that kind of device. Means are then provided for securely affixing the base plate to the forward most portion of the seat or central structural support member for use without a shock absorbing mechanism. Yet other means are provided for securely affixing the base plate in a "floating" configuration to a shock absorbing mechanism located in the forward most portion of the seat or central structural support member. Means are also provided for selectively deactivating said shock absorbing mechanism.

In the bulkhead iteration of this system means are provided for a single bulkhead-style pedal assembly, ergonomically designed to provide a primary contact point at the heel and arch of the foot, and to utilize all but ¼ inch of available lateral space for foot room. Means are provided for securely affixing said bulkhead to an adjustment arm located in the center of the bulkhead. Means are provided for said adjustment arm to depend rearwardly from this bulkhead along the longitudinal axis in the center of the boat. Further means are provided to direct this adjustment arm into and thru a guide that is located and securely affixed to the forward most portion of the seat or central structural support member. Means are then provided to selectively securely affix said adjustment arm to said guide in a plurality of incrementally different positions forwardly or rearwardly. Means are also provided to affix said guide in a "floating" configuration for use with a shock absorbing mechanism. Yet other means are provided for selectively disengaging said shock absorbing mechanism.

It is an object of the present invention to provide a foot brace system for a kayak in which the heel and arch of the foot is the contact point.

It is an object of the present invention to provide a foot brace system for kayaks in which pedal-style or bulkhead-style foot receiving members can be utilized.

It is also an object of the present invention to provide a kayak foot brace system that is easily adjustable in a plurality of incrementally different positions.

Another object of this invention is to provide a foot brace system that can be adjusted by the user without the necessity of exiting the cockpit to do so. (Cockpit adjustable.)

It is an additional object of the present invention to provide a foot brace system that, in the pedal-style configuration, may be adjusted asymmetrically for users who may proffer that.

It is also an object of the present invention to provide a kayak foot brace that occupies a minimal amount of space within the hull of the boat.

It is an object of the present invention to provide a kayak foot brace system that attaches to the seat, or central structural support member, thereby eliminating unnecessary holes in the hull of the boat.

It is a further object of the present invention to provide a foot brace system that can easily be moved from boat to boat.

Another object of the present invention is to provide a kayak foot brace that can easily incorporate a system for the absorption of energy from impact to the feet of the user.

It is a further object of the present invention to provide such energy absorbing capabilities by means of a single central energy, or shock absorbing mechanism.

Yet another object of the present invention is to provide a simple, lightweight, and cost effective system for the absorption of energy to the foot of the user.

A further object of the present invention is to provide a method for inserting a blocking mechanism into the system that will allow the user to selectively deactivate the shock absorber.

Still further objects of the inventive Adjustable Centerline Foot Brace System disclosed herein will be apparent from the drawings and following detailed description thereof.

BRIEF DESCRIPTION OF THE DRAWINGS

It should be noted that some manufacturers are installing a two-part seat assembly consisting of a seat and a central structural support member. The central structural support member allows the seat to be adjusted forward or backward more easily and provides additional buttressing of the cockpit area of the hull. Since it is the forward portion of the seat, or central structural support member that is involved in this invention, and both would be very similar in design in that portion, they will be treated as the same for the purposes of this patent application.

These and other features, aspects, and advantages of the present invention will become better understood with regard to the following description, appended claims, and accompanying drawings where:

DESCRIPTION OF THE PREFERRED EMBODIMENT

It should be noted that the shape, size and angles used in the fabrication of pedal-style foot receiving members in the preferred embodiment are specific to one make and model of a small "rodeo-type" kayak, and a men's size 9 foot of average width. It has been found that for an optimal configuration, even minor changes in the design of these "rodeo-type" kayaks, and/or changes in the size of the foot and length of the leg may alter the requirements of the shape and contact angles of the pedal style foot receiving members. Several different models of pedal style foot receiving members may be necessary to provide a large number of users with an optimal "fit". The bulkhead iteration of this Adjustable Centerline Foot Brace System is intended primarily for larger boats and these parameters are less critical.

Pedal-style Foot Receiving Member

Figure 1:
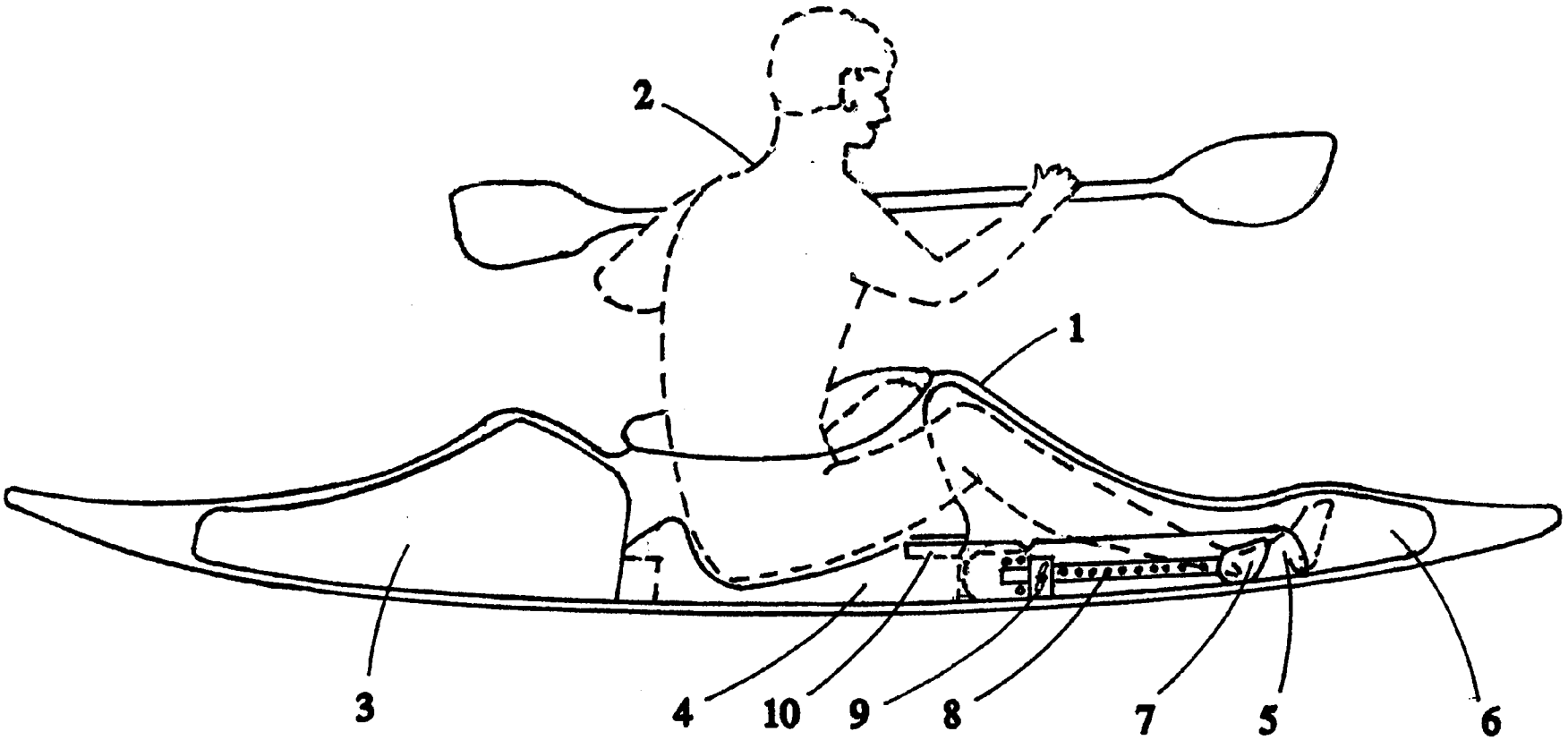
FIG. 1 is a perspective cut-away view of a decked kayak 1 that illustrates rear and front structural support walls 3 and 6, seat 4 or seat and central structural support member 4, location of optional shock absorbing mechanism 10, base plate 5, adjustment arm guide 9, adjustment arm 8, pedal style heel/arch-receiving member 7, and a paddler 2 seated in normal paddling position.
Figure 4:
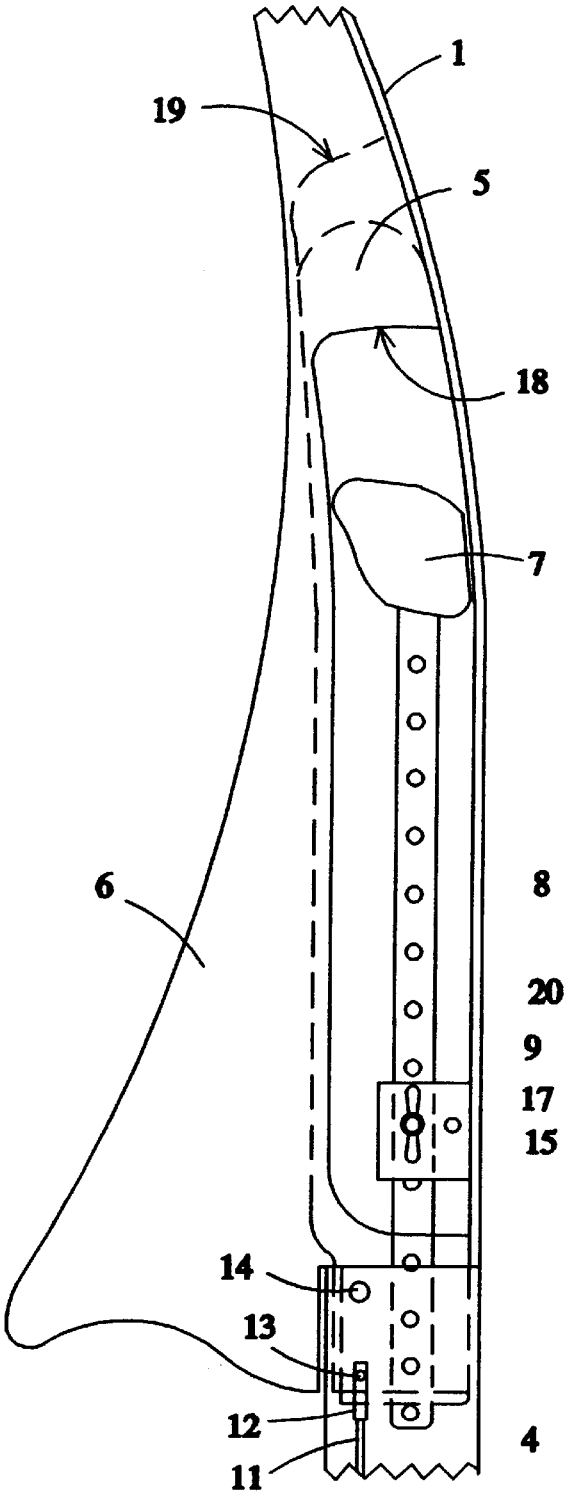
FIG. 4 is a right side view of the entire Adjustable Centerline Foot Brace System. It includes the heel cut out area 18 in the front structural support wall 6 and the extended slot 19 in the center of the structural wall along the longitudinal axis. This slot 19 is necessary for forward travel of the base plate 5 for boats utilizing a shock absorbing system.
Figure 5:
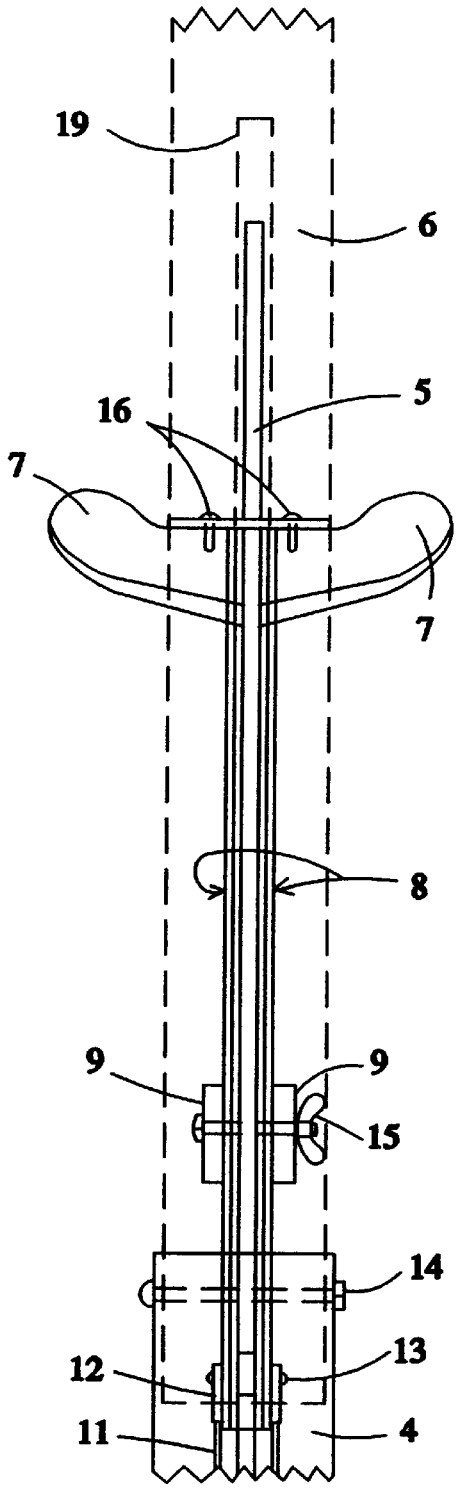
FIG. 5 is an extended top view of the entire Adjustable Centerline Foot Brace System.

Referring now to FIG. 1 of the drawings, generally depicted therein is a kayak 1 to which is mounted an Adjustable Centerline Foot Brace System with shock absorbing mechanism 10 and pedal-style foot receiving members, constructed in accordance with, and embodying the principles of the present invention. A paddler 2 sits within the kayak 1 in normal paddling position and the heel of the paddler's foot is resting against the pedal style foot-receiving member 7. The adjustment arm 8 to which the foot-receiving member 7 is securely affixed (See FIGS. 6, 7, and 8) depends in a rearward direction from the foot-receiving member 7. The adjustment arms 8 are slidingly moved forwardly or rearwardly through guides 9 (See FIG. 3) as necessary to position the foot-receiving members 7 for use by a specific paddler 2. A plurality of apertures 20 (See FIG. 2) are evenly spaced along the length of the adjustment arms 8, and these apertures 20 are aligned with corresponding apertures 35 and 26 (See FIGS. 2, 11, 12, and 13) in the guides 9 and base plate 5. A fastener 15 may then be positioned laterally through adjustment arms 8, guides 9, and base plate 5 to selectively securely affix the foot-receiving members 7 in a specific position. The guides 9 are securely affixed to the base plate 5 by means of a fastener 17 (See FIGS. 2, 11, 12, and 13) that is positioned laterally through apertures 36 and 37. The base plate is inserted into a ¼ inch slot 19 (See FIGS. 4 & 5) in the lateral center of the front structural wall 6 along the longitudinal axis of the kayak 1. The base plate 5 and structural wall 6 are then inserted into and securely affixed to the forward portion of the seat or central structural support member 4 by a fastener 14 (See FIGS. 2 & 3) which is positioned laterally through corresponding apertures 27, 28, and 29 (See FIG. 3) in the seat or central structural support member 4, structural wall 6, and base plate 5. This fastener 14 may be selectively removed to engage the shock absorbing mechanism or installed to disengage the shock absorbing mechanism.

Figure 2:
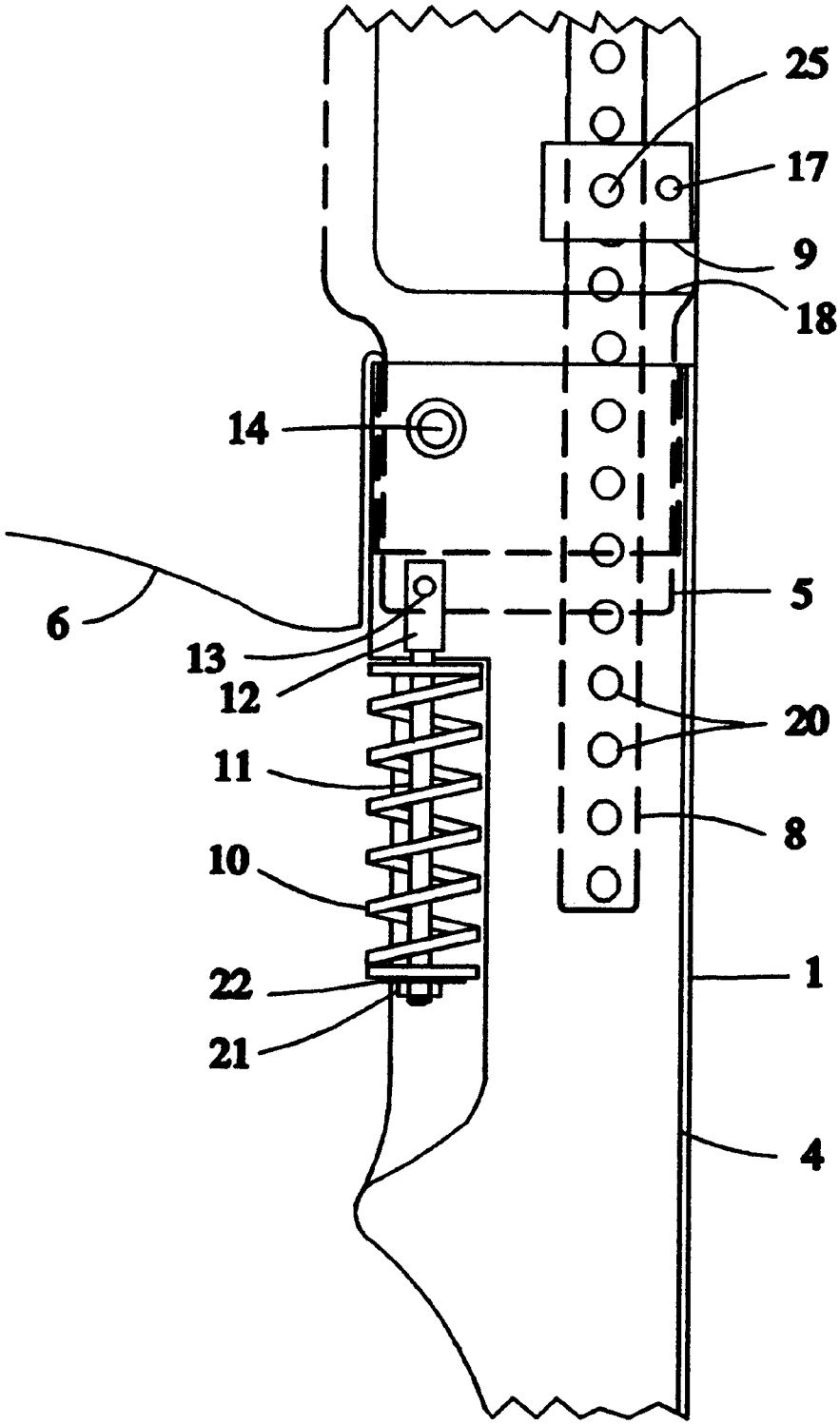
FIG. 2 is a right side view of that portion of the seat or central structural support member 4 that is directly in front of the paddler, and those portions of the foot brace system that are integrated into the seat area or are immediately adjacent to it. Elements of the shock absorbing system are shown in detail 10, 11, 12, 13, 14, 21, and 22 as well as many of the components of the Adjustable Centerline Foot Brace System. 5, 6, 8, 9, 14, 17, 20, and 25. Note that fastener 14 is an element of both systems.
Figure 3:
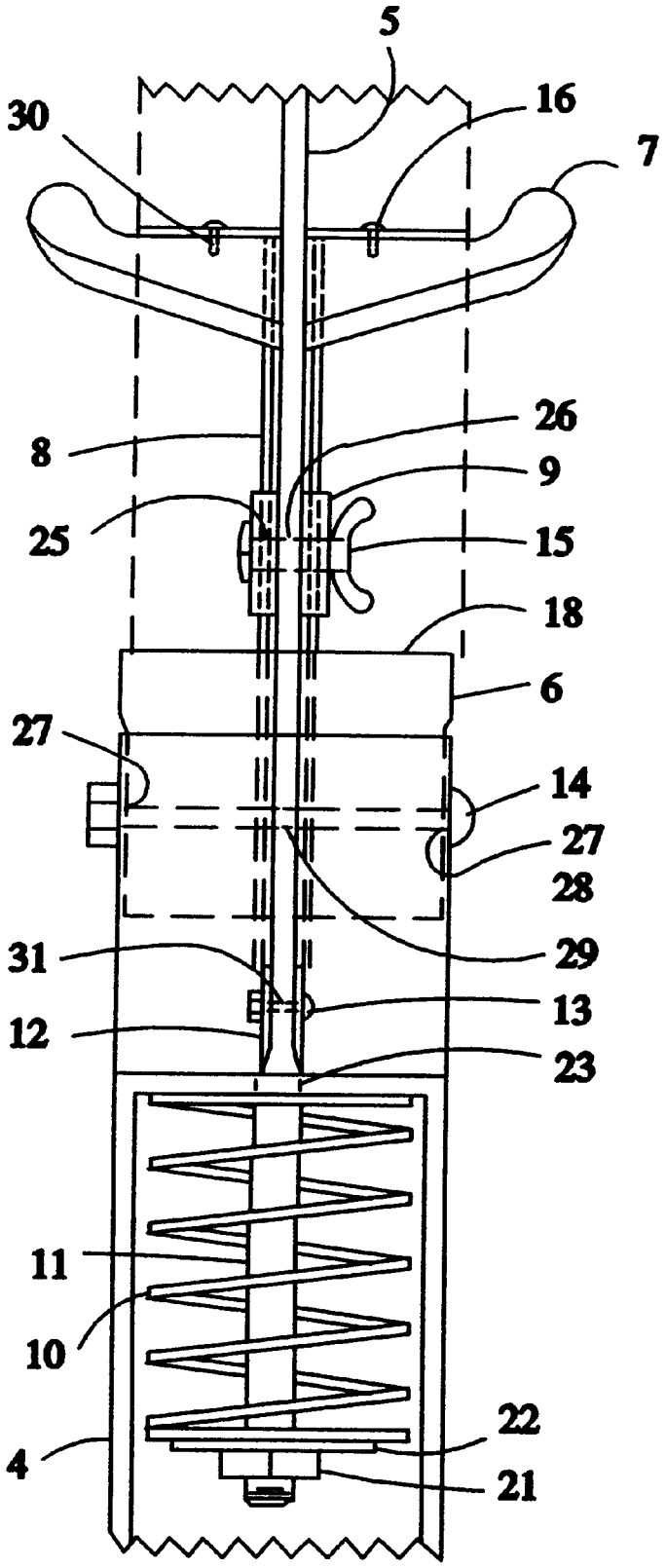
FIG. 3 is a top view of that portion of the seat or central structural support member 4 that is in front of the paddler and includes the shock absorbing system as well as the pedal style foot receiving members 7.
Figure 9:
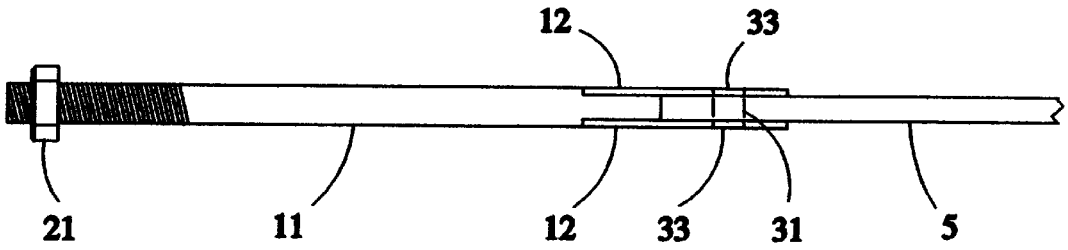
FIG. 9 is a top view of the bolt/bracket central receiving member 11 and 12 of the shock absorbing system showing the configuration of the bracket assembly 12, and apertures 31 and 33 through which the base plate 5 is securely affixed to the bolt/bracket central receiving member 12.
Figure 10:
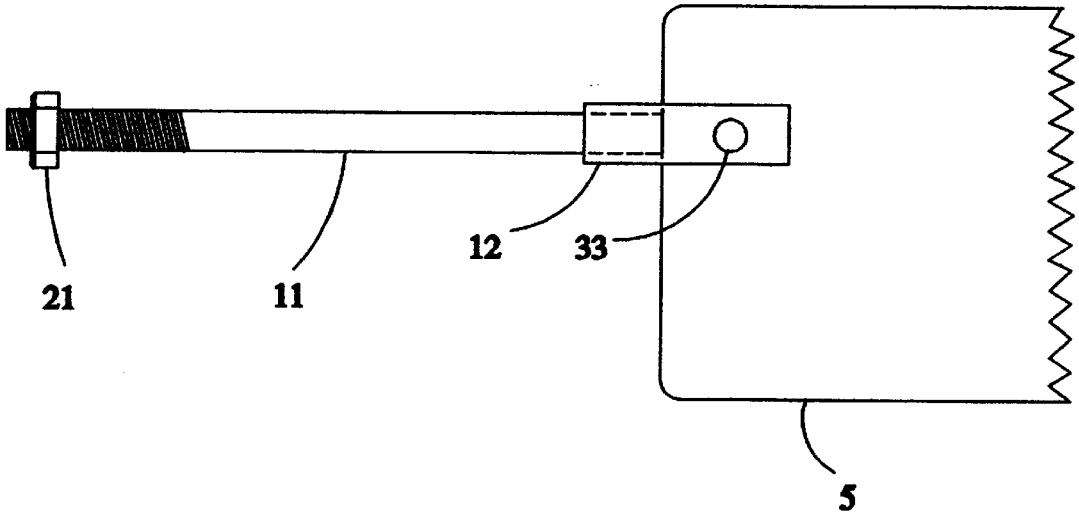
FIG. 10 is a right side view of the bolt/bracket central receiving member 11 and 12 of the shock absorbing mechanism and further illustrates the position of the bolt/bracket assembly 11 and 12 relative to the base plate 5.
Figure 11:
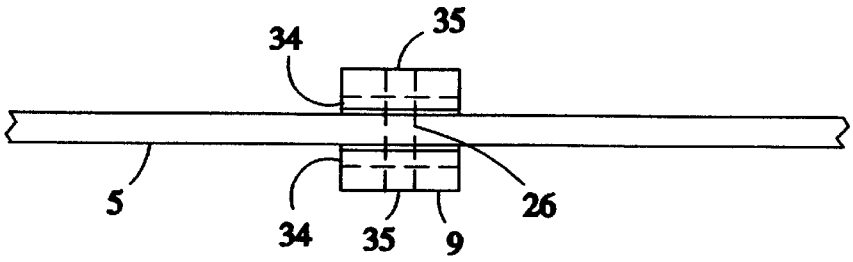
FIG. 11 is a top view of the adjustment arm guides 9 and base plate 5. Apertures 35 in the guides 9 through which the adjustment arms are securely affixed to the base plate 5 and slots 34 through which they are sliding moved, are illustrated.
Figure 12:
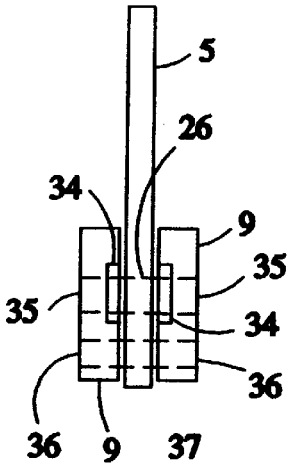
FIG. 12 is a front view of the base plate 5 with guides 9 on each side, again detailing the apertures 35 and 26 through which the adjustment arms are securely afflxed to the base plate 5, and slots 34 through which they are slidingly moved. Apertures 36 and 37 through which the guides 9 are securely affixed to the base plate 5 are also shown.
Figure 13:
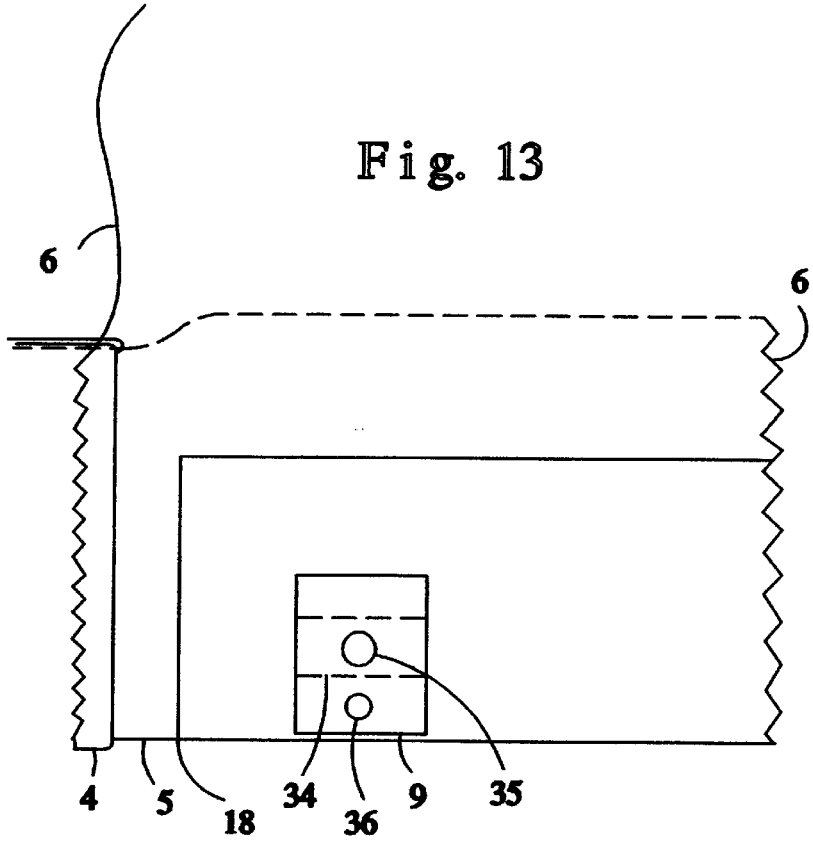
FIG. 13 is a right side view of the base plate 5 and guide 9 with aperture 36 for securely affixing the guide 9 to the base plate 5, aperture 35 for selectively securely affixing the adjustment arms 8 to the base plate 5, and the slots 34 through which the adjustment arms 8 are slidingly moved.

In FIGS. 2 and 3 the shock absorbing system and its attachment point to the base plate 5 can be seen in greater detail. The shock absorbing mechanism depicted for illustrative purposes is a simple spring, but many types of shock absorbers are available (gas filled, liquid filled, elastomers, etc.) and could be easily substituted. The mechanism 10 is held in place by the tension created between the spring retaining clip 22, and the seat or central structural support member 4 when the tensioning nut 21 is tightened against the spring retaining clip 22 or other such similar device. This action compresses the spring 10 between the seat or central structural support member 4 and the spring retaining clip 22. Shock absorbing mechanisms of differing compression factors will be necessary for paddlers of different weights and a dampening mechanism (not shown) for the decompression portion of the shock absorption process may also be desirable depending on the type of shock absorber used. The shock absorbing assembly is also held in place by means of an aperture 23 (See FIG. 3) in the lateral center of the forward portion of the seat or central structural support member 4 through which a portion of the bolt/bracket central receiving member of the shock absorbing mechanism 11 and 12 slidingly moves. The bolt/bracket central receiving member 11 and 12 is a 5/16ths steel shaft approximately 5 inches long and is threaded on one end to receive the tensioning nut 22. The opposing end of the bolt/bracket assembly 12 (see FIGS. 9 & 10) is generally rectangular in shape having opposing sides with dimensions of $1/16^{th}$ by ½-inch by 1½ inches with corresponding apertures 33 drilled in each of the flattened surfaces. The gap between the flattened surfaces of the bolt/bracket assembly 12 is of sufficient width to accept the base plate 5. A corresponding hole 31 in the base plate 5 is aligned with apertures 33 in the bracket end 12 of the bolt/bracket assembly and the bolt/bracket central receiving member 11 and 12 is securely affixed to the base plate 5 by means of a fastener 13. (See FIGS. 2 & 3) When the bow of the kayak 1 is impacted, the force of impact is transferred through the foot-receiving members 7 to the base plate 5 and the bolt/bracket central receiving member 11 and 12. A portion of the bolt/bracket assembly 11 and 12 will then slide forwardly through an aperture 23 in the seat or central structural support member 4 (FIG. 3) resulting in the compression of the spring 10 or other shock absorbing mechanism, and a corresponding dampening of the impact on the users feet.

The base plate 5 of the present invention is made of ¼" polycarbonate plastic but other products of similar structural properties could also be used. The base plate 5 is shaped to conform to the contours of the hull of the kayak it will be used with, and has a generally planar surface 3 inches in height and approximately 24 inches in length. These dimensions and shape will vary, however, with the make and model of kayak that the device is used with. If the base plate 5 is to be used in conjunction with a shock absorbing system the ¼ inch slot in the front structural wall 19 that the base plate 5 is inserted into must be of sufficient length to allow,for the forward travel of the base plate 5 when the shock absorbing mechanism 10 is engaged. It should also be noted that if a shock absorbing mechanism is not intended for use with the foot brace system, the base plate 5 could be manufactured as an integral part of the front structural wall 6. Securely affixing the base plate 5 into the front structural wall 6 can be accomplished with contact cement or other types of glue or fastening systems, and would enhance the structural properties of the structural wall 6 as well as provide the base plate for the Adjustable Centerline Foot Brace System.

Using FIGS. 2, 3, 6, 7, and 8, it can be seen that the foot-receiving members 7 are securely affixed to the adjustment arms 8. These adjustment arms 8 are made from $1/8^{th}$ inch by 1-inch aluminum bar stock, having an overall length of approximately 14 inches and depend outwardly from the longitudinal axis of the kayak 1 at a 90 degree angle for the two inches in the forward-most portion of the arms. A series of apertures 20 ⅜ths of an inch in diameter are evenly spaced along the longitudinal axis of the adjustment arms 8 from a point approximately 2 inches rearward from the foot-receiving members 7, rearwardly to the end of the adjustment arms 8. The adjustment arms 8 are slidingly moved forwardly or rearwardly through slots 34 in guides 9 (See FIGS. 11, 12, and 13). The guides 9 are made from H.D.P.E. (High Density Poly-Ethylene) but any similar materials such as Nylon or Teflon would work as well. The guides 9 measure approximately ⅜ths of an inch thick by 1¼ by 1¾, and have a slot 34 routed or molded in one side that is $1\frac{1}{16}^{th}$ inch wide by 3/16ths of an inch deep. An aperture 35 ⅜ths of an inch in diameter is drilled laterally through the center of this slot 34, and another aperture 36 7/32nds of an inch in diameter is located directly below this slot 34. A fastener 17 is positioned laterally through apertures 36 and 37 to securely affix the guides 9 to the base plate 5. Securely affixing the guides 9 to the base plate 5 in this manner will allow guides 9 to pivot slightly as the adjustment arms 8 are slidingly moved along the changing contours of the hull of the kayak 1. When the adjustment arms 8 are slidingly moved through the guides 9, any one of the apertures 20 in the adjustment arms 8 may be aligned with a corresponding aperture 26 in the base plate 5. A pin or other such fastener 15 may then be positioned laterally through apertures 35 and 26 in the guides 9 and base plate 5 to selectively securely affix the foot-receiving members 7 in a specific position.

Figure 6:
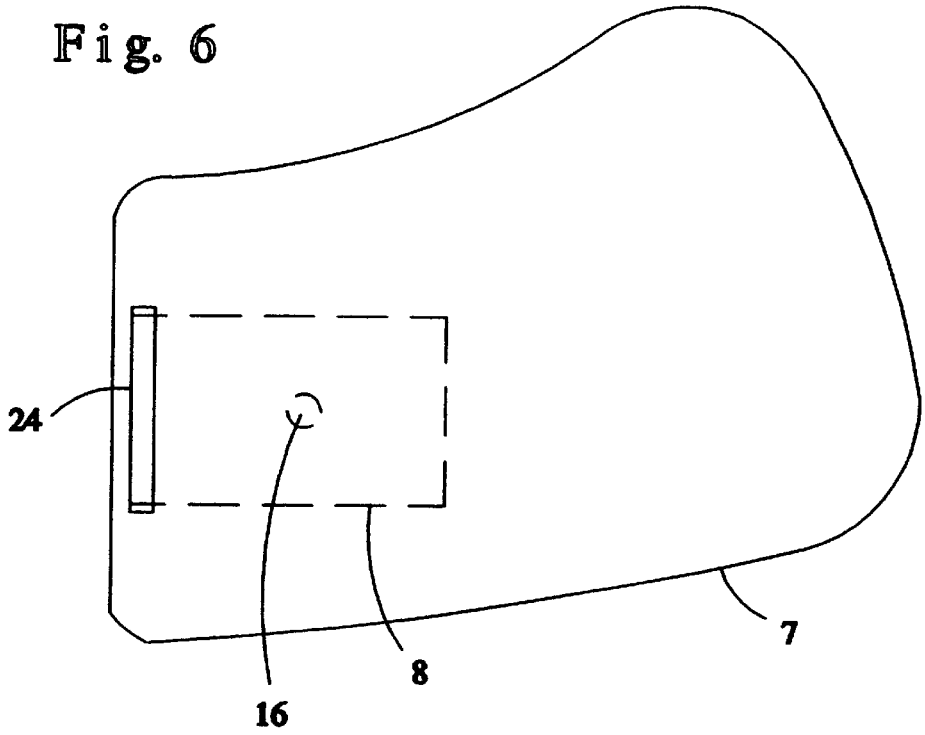
FIG. 6 is a front view of the pedal style foot-receiving member assembly that shows the location of one of the slots 24 through which the adjustment arm 8 is positioned and the position of the fastener 16 that securely affixes said adjustment arm 8 to the heel/arch-receiving member 7.
Figure 7:
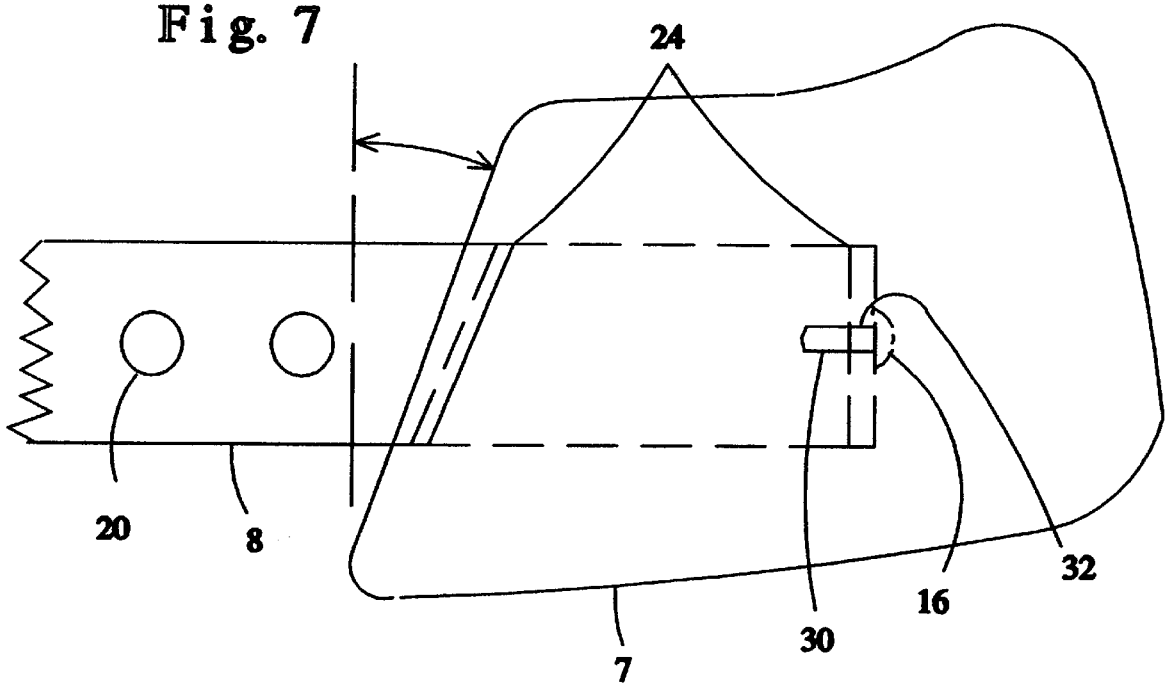
FIG. 7 is a right side view of the pedal style foot-receiving member 7 assembly and illustrates the forward angle of the foot-receiving member 7 relative to the vertical plane. The mounting insert 30, fastener 16, and aperture 32 in the adjustment arm through which the fastener 16 is positioned to securely affix the adjustment arm 8 to the foot receiving member 7 is also detailed.
Figure 8:
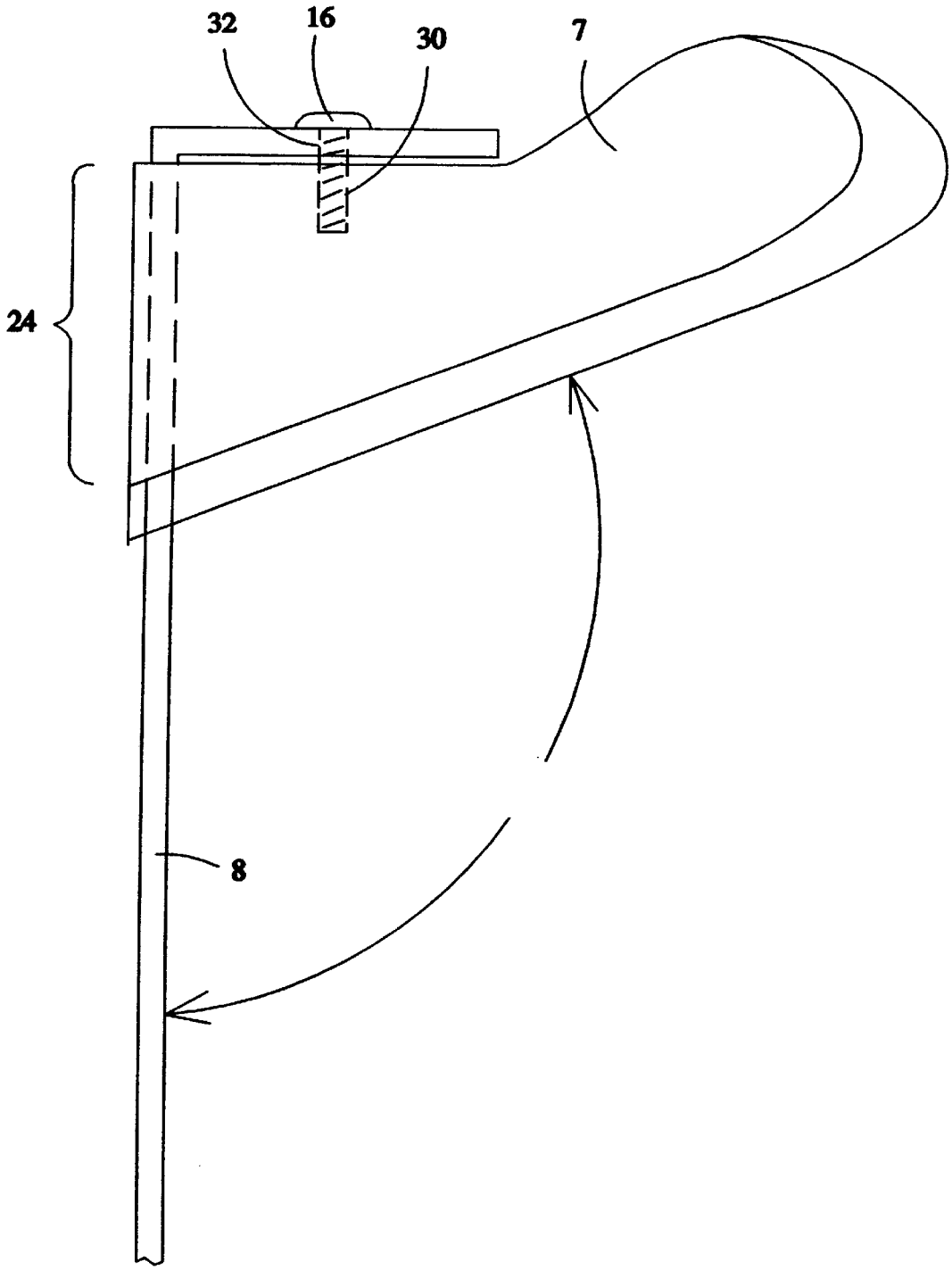
FIG. 8 is a top view of the pedal style foot-receiving member assembly that illustrates the forwardly depending angle of the foot-receiving member 7 relative to the longitudinal axis of the adjustment arm 8. In this view both slots 24 through which the adjustment arm 8 is positioned can be seen.

FIGS. 6, 7, and 8 detail the shape, and methods for securely affixing the foot-receiving members 7 to the adjustment arms 8. The foot-receiving members 7 depicted would be molded from plastic or other similar products. Nylon, polyethylene, or polycarbonate plastic could be used solely, or in combination with other materials such as aluminum or other metal products for the fabrication of the foot-receiving member 7. The prototype foot receiving-members were created using aluminum, polycarbonate plastic, and closed cell foam, for example. In the preferred embodiment, however, a molding process such as rotational or injection molding would be the best method for the creation of the foot-receiving member 7. In FIG. 7 and 8 it can be seen that the foot-receiving member 7 depends outwardly from the longitudinal axis of the adjustment arm 8, and that portion of the foot-receiving member 7 that contacts the heel and arch of the foot depends outwardly and forwardly at an angle of 110 degrees relative to the longitudinal axis of the adjustment arm 8 and has a pitch or forward tilt of 15 degrees relative to the vertical plane. That portion of the foot-receiving member 7 that contacts the heel and arch of the foot has a generally planar surface for approximately 2½ inches before beginning a shallow forward curve which approximates a portion of the concave curvature of the arch of the foot. The general outline of the shape of the foot-receiving member 7 is roughly that of the bottom portion of the foot from the heel forward for approximately 4 inches. The bottom portion of the foot-receiving member 7, (that portion closest to the hull of the boat), curves upwardly away from the hull to minimize contact with the hull's surface.

In FIG. 8 it can be seen that the long portion of the adjustment arm 8 is positioned through a pair of apertures 24 in the foot receiving member 7 and is slidingly moved through those slots 24 until that portion of the adjustment arm 8 which depends outwardly at a 90 degree angle from the longitudinal axis comes in contact with that portion of the foot receiving member 7 containing a brass or aluminum mounting insert 30. (Mounting inserts 30 are elongated internally threaded brass or aluminum components that have circumferential grooves in their outer surfaces to enhance the engagement of the insert with the plastic it is molded into. The inserts are held in position during the molding process and become an integral part of the final molded product.) A fastener 16 may then be positioned through apertures 32 in the adjustment arm and securely affixed within the mounting insert 30. This process could also be accomplished by molding the adjustment arm 8 directly into the pedal style foot-receiving members 7, but that would negate the ability to change the model of the foot receiving-members 7 without switching the adjustment arms 8 as well.

Bulkhead-style Foot Receing Member

Figure 14:
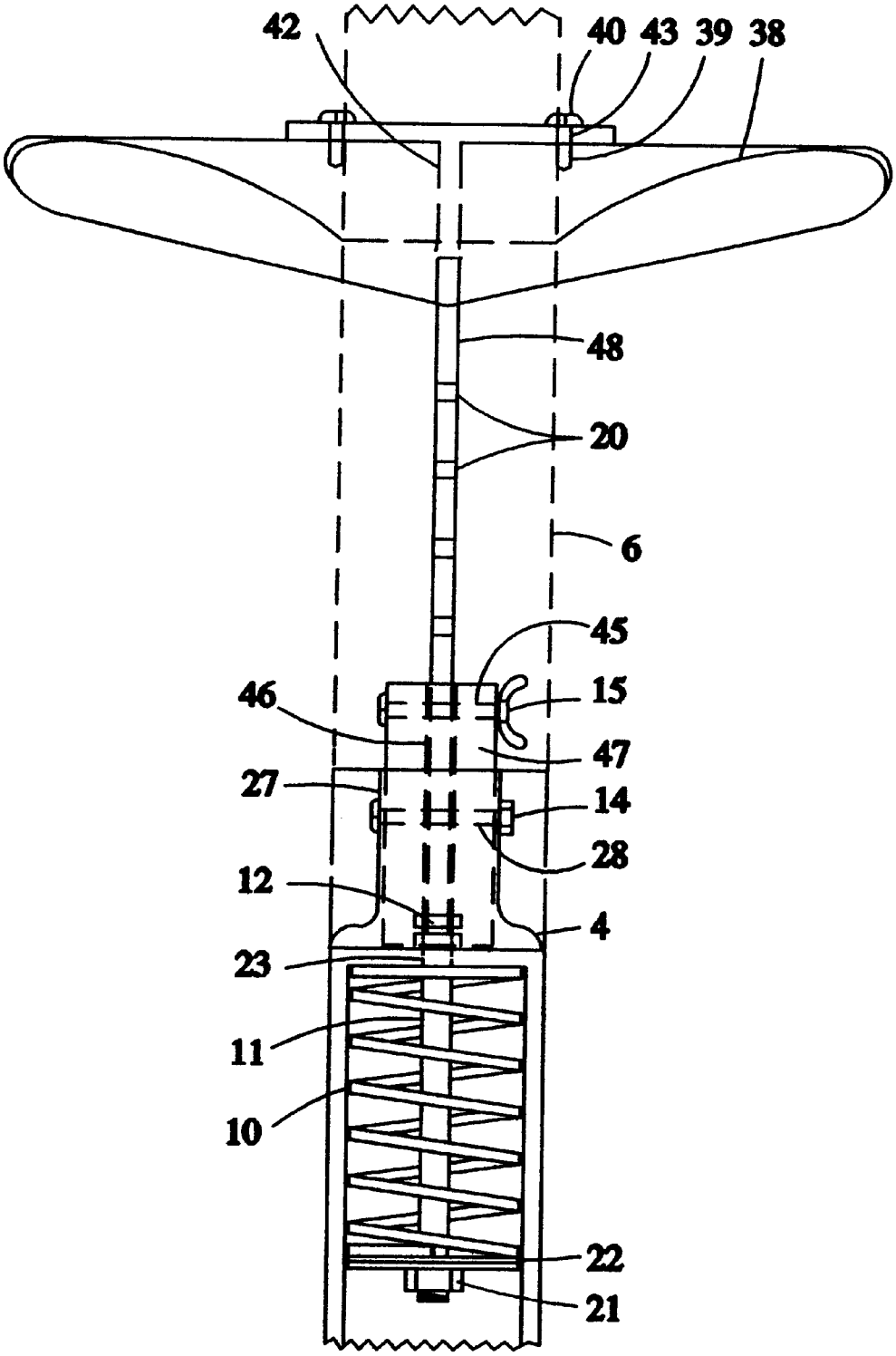
FIG. 14 is an overhead view of the bulkhead. 38 iteration of the present invention detailing all aspects the assembly including the optional shock absorbing mechanism 10.
Figure 15:
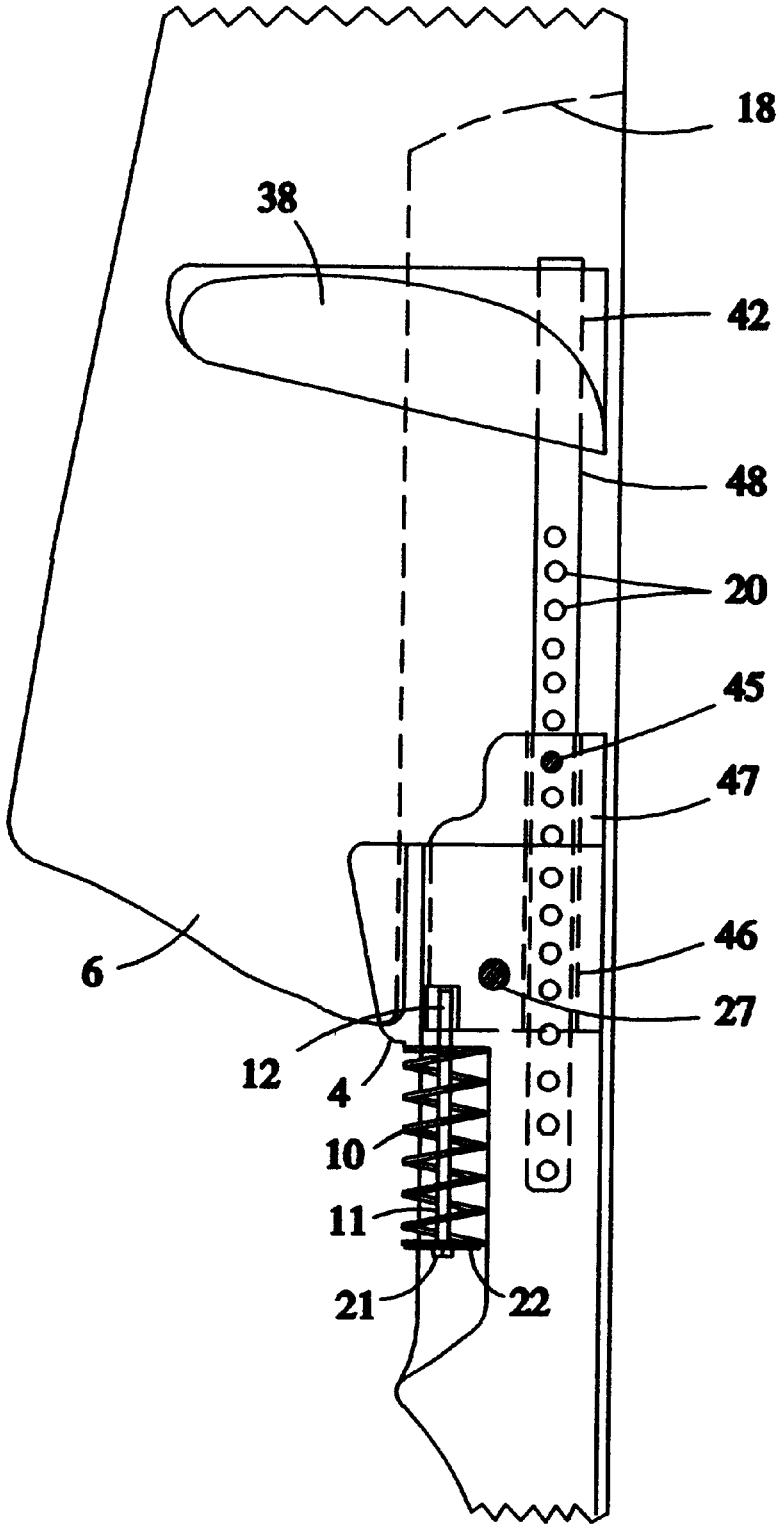
FIG. 15 is a right side view of the bulkhead 38 style foot-receiving assembly including the optional shock absorbing mechanism 10.
Figure 16:
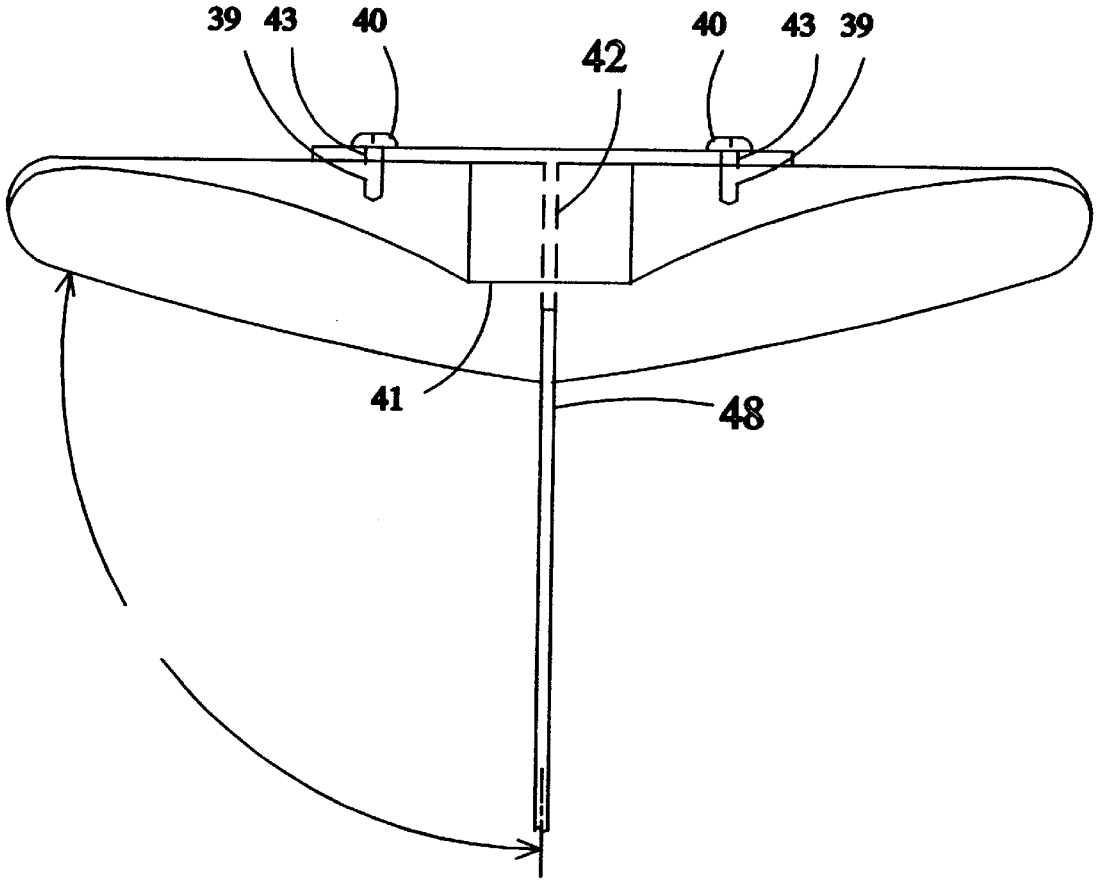
FIG. 16 is an overhead view of the bulkhead foot-receiving member 38 detailing the attachment points of the adjustment arm 48, mounting inserts 39, and the forwardly depending angle of the bulkhead foot receiving member 38 relative to the adjustment arm 48.
Figure 17:
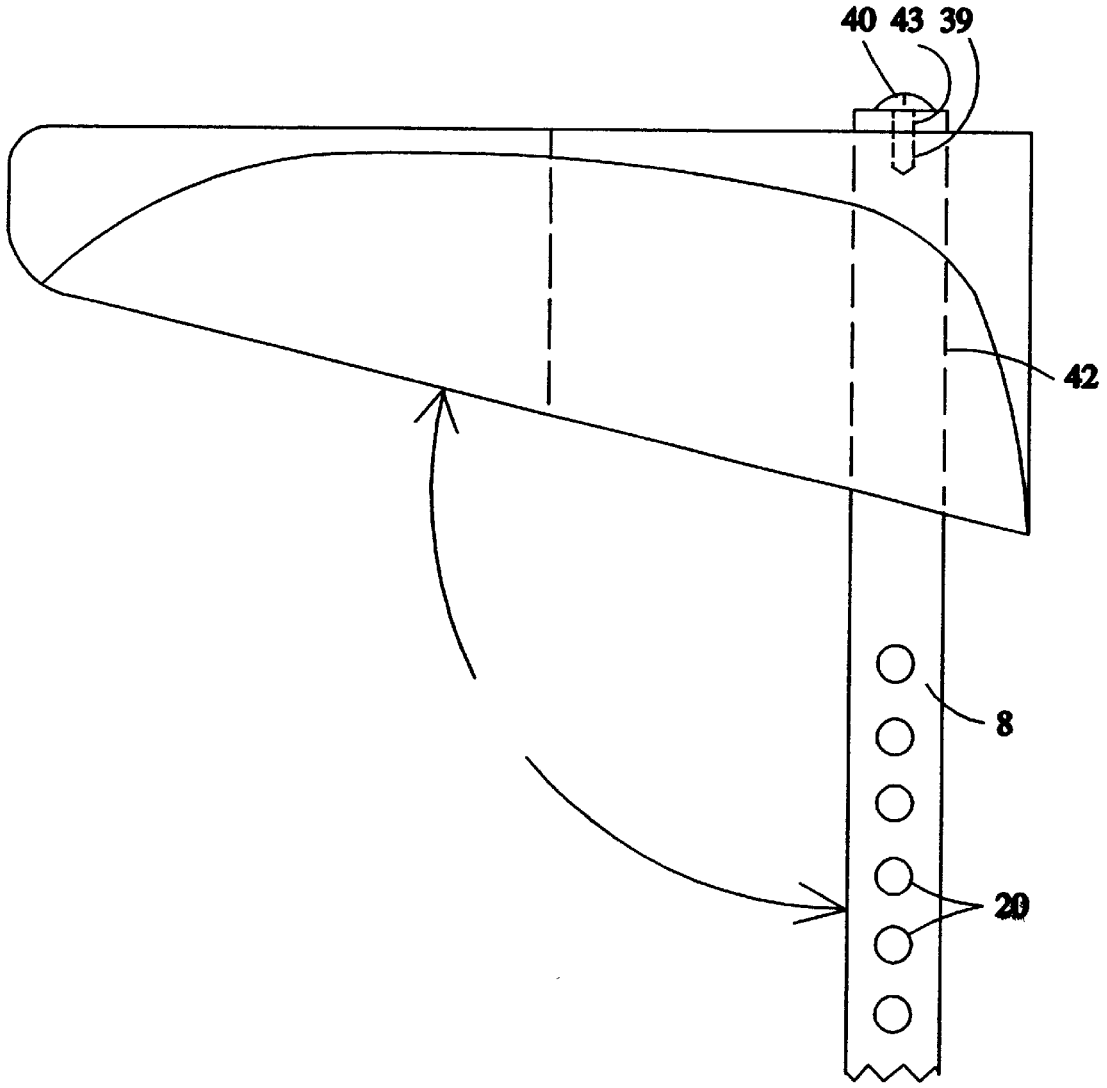
FIG. 17 is a right side view of the bulkhead foot receiving member 38 and adjustment arm 48 showing the relationship of the adjustment arm 48 to the bulkhead foot receiving member 38, the slot 42 through which the adjustment arm 48 is positioned, and the forwardly depending angle of the bulkhead foot receiving member 38 relative to the vertical plane.
Figure 18:
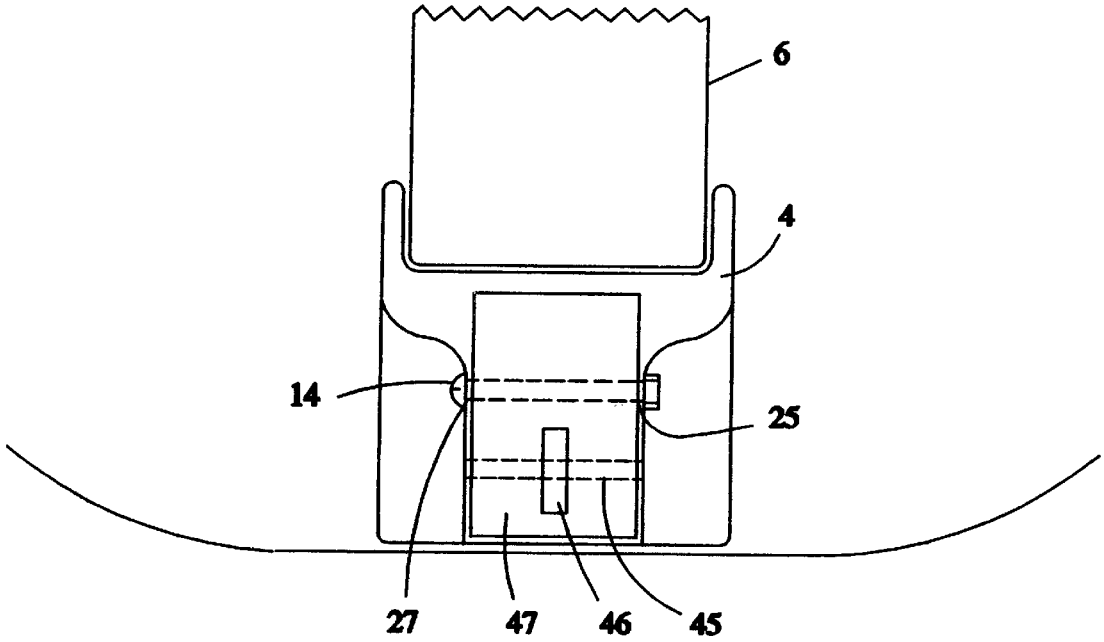
FIG. 18 is a cross-sectional end view of the bulkhead style iteration of the present invention illustrating the relationship of the guide 47 within the seat or central structural support member 4, the fastener 14 used to secure the guide 47 from movement and disengage the shock absorbing mechanism, and the aperture 45 through which a fastener is positioned to selectively secure the adjustment arm in a specific position. The slot 46 through which the adjustment arm slidingly moves is also depicted.
Figure 19:
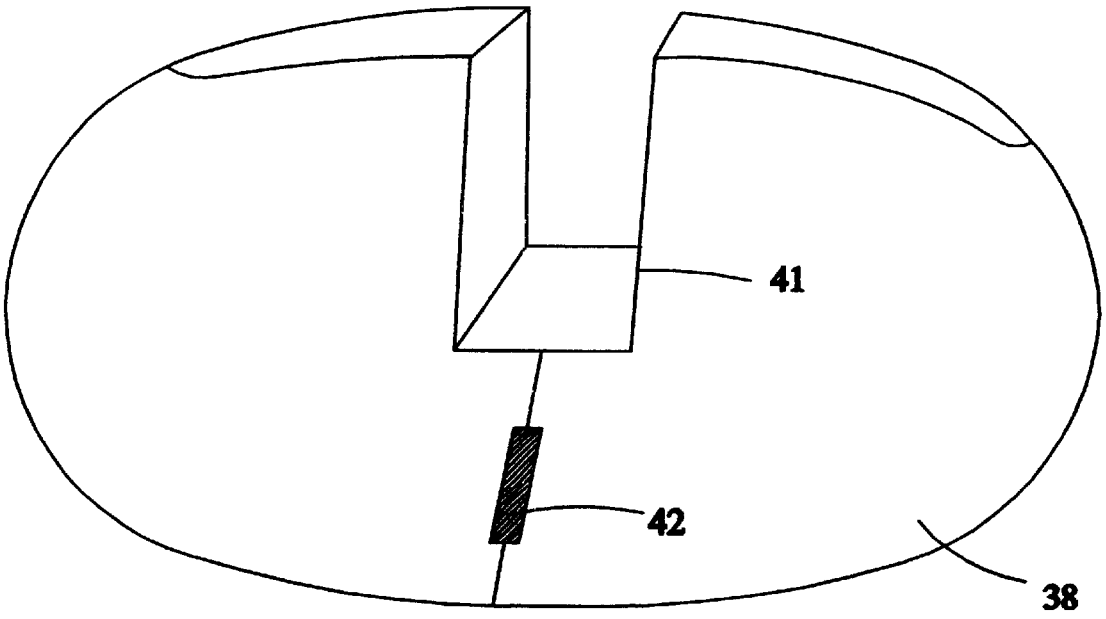
FIG. 19 is a perspective view of the bulkhead style foot-receiving member 38 illustrating the slot 41 for the front structural wall to ride in, and the slot 42 for the adjustment arm.
Figure 20:
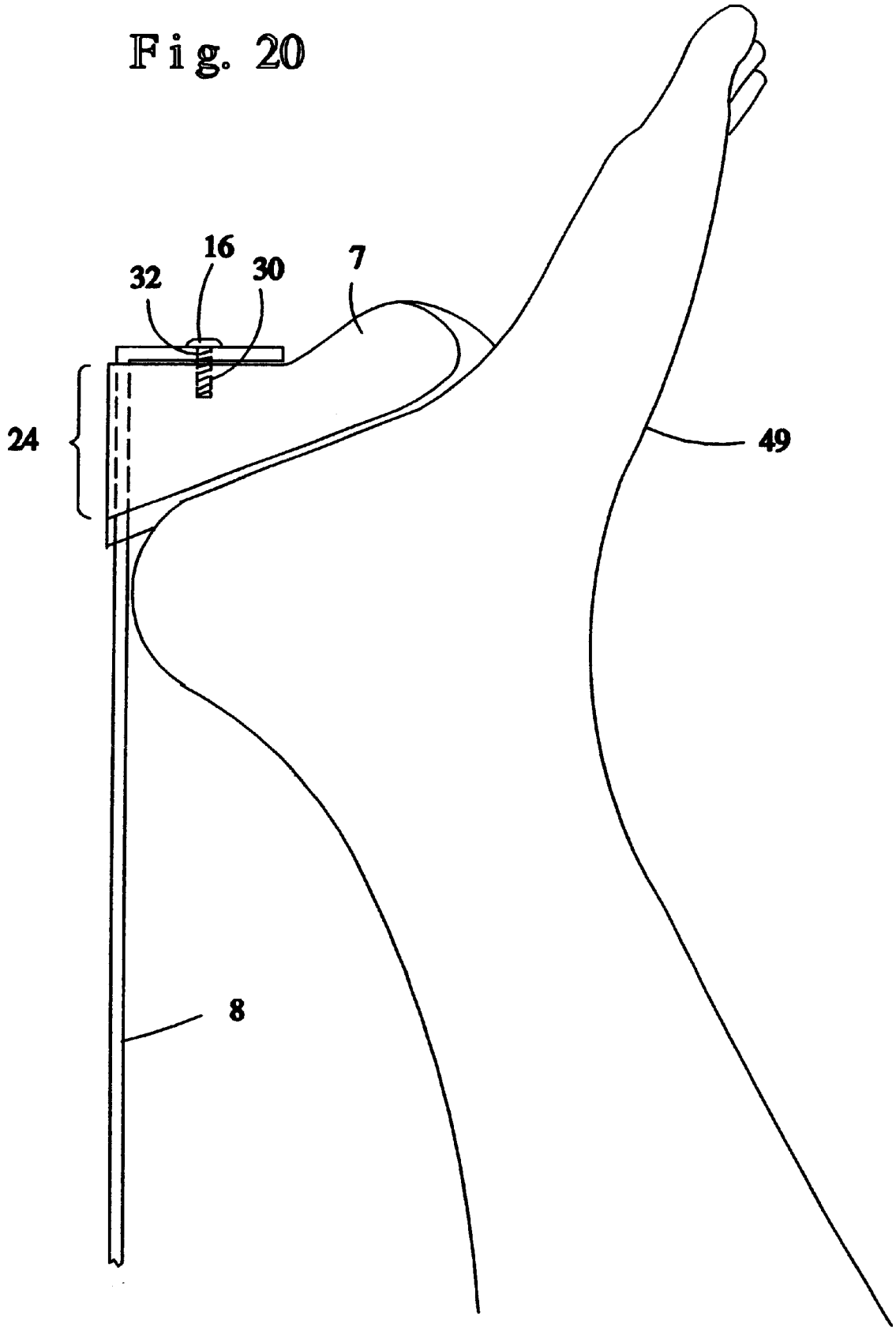
FIG. 20 is an overhead view of the relationship of the paddler's foot 49, to the pedal style foot receiving member 7.

Referring now to FIG. 14 and 15 generally depicted therein is the bulkhead 38 iteration of the present invention. The bulkhead foot-receiving member 38 (see FIG. 16, 17, & 19) would be rotationally molded from polyethylene plastic as a single unit with a slot 42 through which the adjustment arm 48 would depend in a rearward direction. This adjustment arm 48 is made from ¼"×1" aluminum approximately 16 inches in length and T shaped. The adjustment arm 48 is positioned through a slot 42 molded into the bulkhead foot-receiving member 38 until that portion of the adjustment arm 48 that depends laterally approximately 4" in each direction from the center comes in contact with that portion of the bulkhead foot receiving member 38 that contains the mounting inserts 39. Fasteners 40 are then inserted through apertures 43 in the adjustment arm 48 and securely affixed to the bulkhead foot-receiving member 38 using these mounting inserts 39. A series of apertures 20 ⅜ths of an inch in diameter are evenly spaced along the longitudinal axis of the adjustment arm 48 from a point approximately 2 inches rearward from the bulkhead style foot-receiving member 38 rearwardly to the end of the adjustment arm 48. The adjustment arm 48 is slidingly moved forwardly or rearwardly through a slot 46 that has been molded into a guide 47 and is selectively securely affixed to this guide 47 in a plurality of incrementally different positions by aligning any one of the apertures 20 in the adjustment arm 48 with aperture 45 in the guide 47 and inserting a fastener 15 or pin. This guide 47 would be molded from polyethylene plastic or any other similar product with a slot 46 dimensioned to receive the adjustment arm 48 and allow it to move freely forwardly or rearwardly within this slot 46. The guide 47 is approximately 3" in height and 4" in length by 2" wide and is positioned within the forward portion of a seat or central structural support member 4 that has been designed and dimensioned to accept it. When fastener 14 (see FIG. 18) is inserted laterally through apertures 27 in the seat or central structural support member 4 and corresponding aperture 25 in the guide 47, the shock absorbing mechanism 10 is disengaged and the guide 47 is prevented from moving in a forwardly direction. The shock absorbing mechanism 10 is securely affixed to the guide 47 by the bolt/bracket central receiving member 11 in a similar fashion to that described in the pedal style 7 iteration of the present invention. The mechanism 10 is held in place by the tension created between the spring retaining clip 22, and the seat or central structural support member 4 when the tensioning nut 21 is tightened against the spring retaining clip 22 or other such similar device. This action compresses the spring 10 between the seat or central structural support member 4 and the spring retaining clip 22. The shock absorbing assembly is also held in place by means of an aperture 23 (See FIG. 3) in the forward portion of the seat or central structural support member 4 through which a portion of a bolt/bracket central receiving member of the shock absorbing mechanism 11 and 12 slidingly moves. When the bow of the kayak 1 is impacted, the force of impact is transferred through the bulkhead foot receiving member 38 to the guide 47 and the bolt/bracket central receiving member 11 and 12. A portion of the bolt/bracket assembly 11 and 12 will then slide forwardly through aperture 23 in the seat or central structural support member 4 (FIG. 3) resulting in the compression of the spring 10 or other shock absorbing mechanism, and provide a corresponding dampening of the impact on the users feet.

While a preferred embodiment has been shown and described, it is intended that the present descriptions be illustrative of the features encompassed by the appended claims, and that changes and variations may be made without departing from the spirit or scope of the following claims.

I claim:

1. An adjustable centerline foot brace system for a kayak, said kayak having a front bow section and a rear stem section; an upper deck section and a lower hull section, said deck and said hull sections defining therebetween in said bow section a cavity; a longitudinal structural support member extending between said bow section and said stern section along said hull section, said longitudinal structural support member defining a longitudinal axis of said kayak; and a central support member located between said bow section and said stern section; said adjustable centerline foot brace system comprising:

a baseplate connected to said central support member, said baseplate extending longitudinally from said central support member towards said cavity;

at least a first guide located adjacent a first side of said baseplate;

at least a first adjustment arm, said adjustment arm being slidably received in said guide, said adjustment arm having a proximate end extending toward said central support member and a distal end extending away from said central support member;

at least a first foot-receiving member secured at said distal end of said adjustment arm; and at least one fastener for selectively fastening said adjustment arm to said baseplate to prevent sliding movement of said adjustment arm in said guide;

whereby said user may selectively slide said adjustment arm in said guide to select a distance between said foot-receiving member and said central support member and thereafter fasten said fastener to maintain said distance.

2. The system according to claim 1, wherein said foot-receiving member is shaped to receive both feet of a user of said kayak.

3. The system according to claim 1, wherein said foot-receiving member is shaped to receive the heel and arch portions of the foot of a user of said kayak.

4. The system according to claim 1, further comprising:

a second guide located adjacent a second side of said baseplate; and a second adjustment arm, said second adjustment arm being slidably received in said second guide, said second adjustment arm having a proximate end extending toward said central support member and a distal end extending away from said central support member;

wherein said fastener is operative to selectively fasten said first and said second adjustment arms to said baseplate to prevent sliding movement of said arms in said guides.

5. The system according to claim 4, wherein said foot-receiving member is secured to the distal ends of said first and said second adjustment arms.

6. The system according to claim 4, further comprising:

a second foot-receiving member secured at said distal end of said second adjustment arm;

whereby said user may selectively slide said first adjustment arm in said first guide to select a first distance between said first foot-receiving member and said central support member, and said user may selectively slide said second adjustment arm in said second guide to select a second distance between said second foot-receiving member and said central support member and thereafter fasten said fastener to maintain said first and said second distances.

7. The system according to claim 1, wherein said longitudinal structural support member has a longitudinally extending upwardly open slot and wherein a bottom edge of said base plate is received within said slot.

8. The system according to claim 1, wherein said baseplate is connected to said central support member via a shock absorbing mechanism.

9. The system according to claim 8, further comprising:

a selectively engageable shock absorbing mechanism lock, whereby when said lock is engaged said shock absorbing mechanism is disabled and when said lock is disengaged said shock absorbing mechanism is enabled.

10. The system according to claim 1, wherein said central support member comprises a seat for a user of said kayak.

* * * * *